US005979149A

United States Patent [19]

Martin

[11] Patent Number: 5,979,149

[45] Date of Patent: Nov. 9, 1999

[54] STIRRUP

[75] Inventor: Jack L. Martin, Libertyville, Ill.

[73] Assignee: Libertyville Saddle Shop, Inc., Libertyville, Ill.

[21] Appl. No.: 09/022,098

[22] Filed: Feb. 11, 1998

[51] Int. Cl.[6] ..... B68C 3/02

[52] U.S. Cl. ..... 54/49

[58] Field of Search ..... 54/47, 48, 49, 54/49.5

[56] References Cited

U.S. PATENT DOCUMENTS 21,764 10/1858 Loudon et al. ..... 54/49

908,265 12/1908 Ivey ..... 54/49

1,044,419 11/1912 Reed ..... 54/49

*Primary Examiner*—Robert P. Swiatek

*Assistant Examiner*—Son T. Nguyen

*Attorney, Agent, or Firm*—Trexler, Bushnell, Giangiorgi & Blackstone, Ltd.

[57] ABSTRACT

A stainless steel stirrup with a rotatable foot plate pivotally connected to the lower ends of the stirrup limbs and including means for restricting the forward rotation of the stirrup to a substantially horizontal position with respect to the stirrup limbs but allowing the stirrup to rotate freely in a backward direction through a range of approximately 90°.

8 Claims, 2 Drawing Sheets

STIRRUP

This invention relates to stirrups used in horse back riding.

OBJECTS AND SUMMARY OF THE INVENTION

A principal object of the invention is to provide a stirrup which will facilitate and promote the "heels down, toes up" position of a rider's foot.

Another object is to provide a stirrup with a feature which will minimize the undesirable forward tendency or the "toes down" characteristic.

Another object is to provide a stirrup with a safety feature wherein the forward rotation of the foot plate is limited in order to minimize the possibility of a rider's foot sliding through the stirrup and to provide a backward heels down release in case of fall or accident.

A further object of the invention is to provide a stirrup wherein the foot plate pivots or rotates backwards with respect to the limbs in a range substantially between 0° and 90° to facilitate a "heels down, toes up" position for the rider.

Another object of the invention is to provide coacting stop means on the lower ends of the stirrup limbs and at each end of the foot plate to limit the rotation of the foot plate with respect to the limbs to 0° degrees in one direction wherein the foot plate and the limbs are substantially at right angles, to as much as 90 degrees in the opposite direction.

Another object of the invention is to provide a stirrup in which the foot plate is pivotable about the lower ends of the stirrup limbs from a locked position in which the foot plate is substantially perpendicular to the stirrup limbs to a position wherein the foot plate is substantially parallel to the stirrup limbs.

Another object is to provide a stirrup which takes pressure off the ankle and calves of a rider and promotes a stable and correct leg position.

Another object of the invention is to provide a stirrup which facilitates mounting a horse by providing a solid foot bed.

Additional objects and features of the invention will become more apparent from the following description and accompanying drawings.

DESCRIPTION OF THE PREFERRED EMBODIMENT

Figure 1:
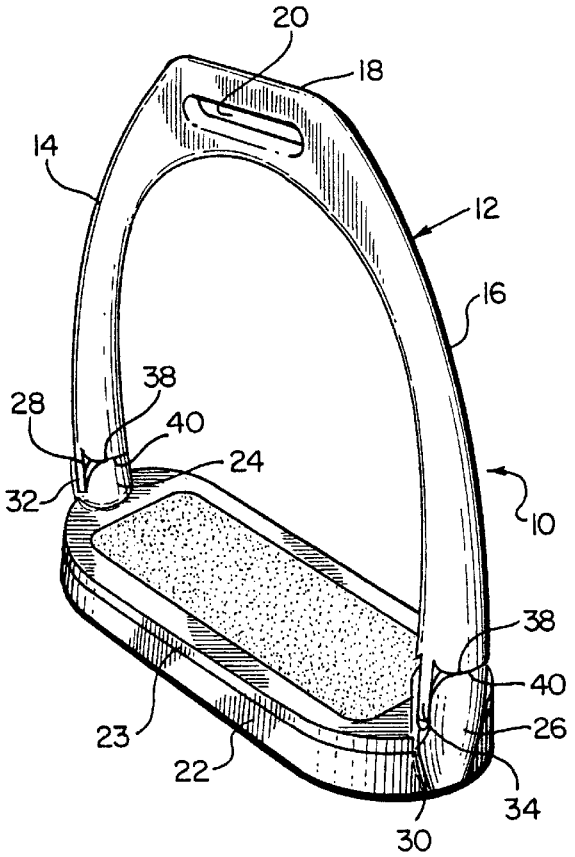
FIG. 1 is a perspective view in elevation of the stirrup embodying the invention herein.
Figure 2:
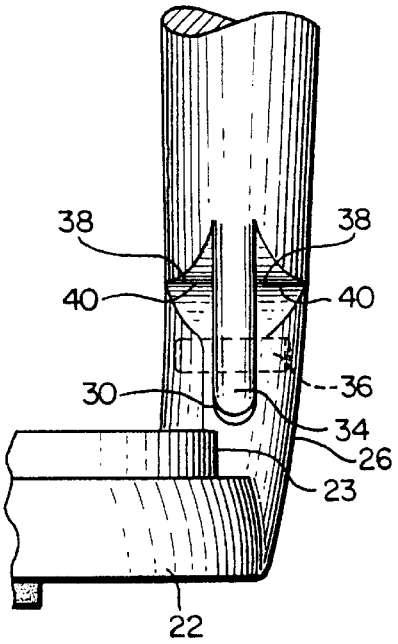
FIG. 2 is an enlarged partial front view in elevation of the right end of the stirrup of FIG. 1 showing the pivotal connection between the lower end of the stirrup limb and the end of the foot plate.

We refer now to the drawings wherein like reference characters refer to like parts. FIG. 1 is a perspective view of a stirrup 10 embodying the invention herein. The stirrup 10 comprises an inverted generally U-shaped frame 12 having two limbs 14 and 16 and an attachment portion 18 at the apex of the frame. An aperture 20 in the attachment portion is provided to accommodate a stirrup leather. The stirrup 10 also includes a foot plate 22 which is pivotally mounted at the lower ends of the two limbs 14 and 16. The stirrup preferably is made of stainless steel.

The foot plate 22 may be constructed with an elongated aperture (not shown) to receive there through a foot pad 23 which, as is well known in the art, may be made of resilient rubber-like material. The foot pad 23 usually is formed with an enlarged bottom portion 23*a* which is designed to secure the foot pad 23 in the aperture (not shown). The foot pad is easily removable and interchangeable as wear may dictate.

Pivotal connections formed at the ends of the foot plate 22 permit the foot plate 22 to pivot about the lower ends of the limbs 14 and 16. In the preferred embodiment the foot plate 22 is formed with integral small protrusions 24 and 26 at each end of the foot plate. These small protrusions 24 and 26 are designed to permit the construction of a pivotal connection with the lower ends of the limbs 14 and 16 as close as possible to the plane of the foot plate. Transverse grooves 28 and 30 are formed in the protrusions 24 and 26 respectively to receive tongues 32 and 34 integrally formed on the lower ends of the limbs 14 and 16. Pivot pins 36 extending through the tongues 32, 34 and into protrusions 24 and 26 allow the foot plate 22 to pivot about the lower ends of the limbs 14 and 16.

Figure 3:
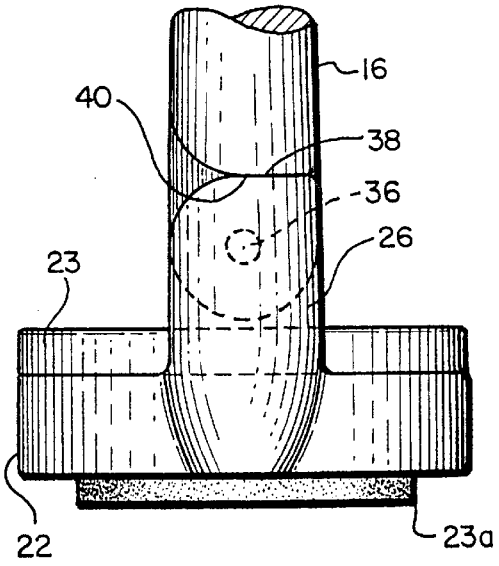
FIG. 3 is an enlarged partial right end view in elevation of the pivotal connection between the lower end of the stirrup limb and the end of the foot plate showing the coacting stop means in abutting position and the stirrup limb and foot plate in a locked position.
Figure 4:
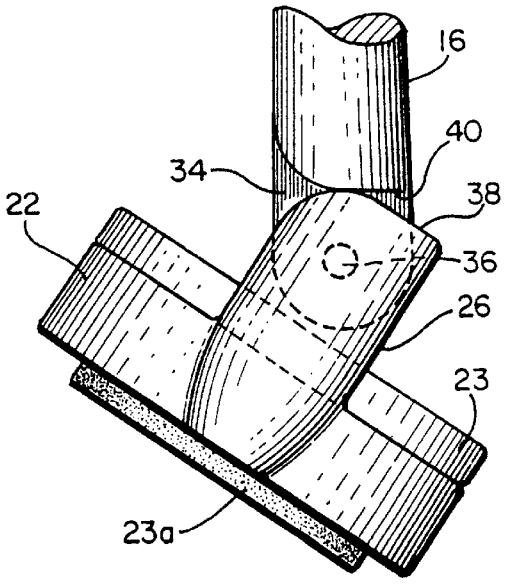
FIG. 4 is an enlarged partial end view in elevation of the pivotal connection shown in FIG. 3 but with the foot plate tilted backwards to permit a "heels down, toes up" position of a rider's foot.
Figure 5:
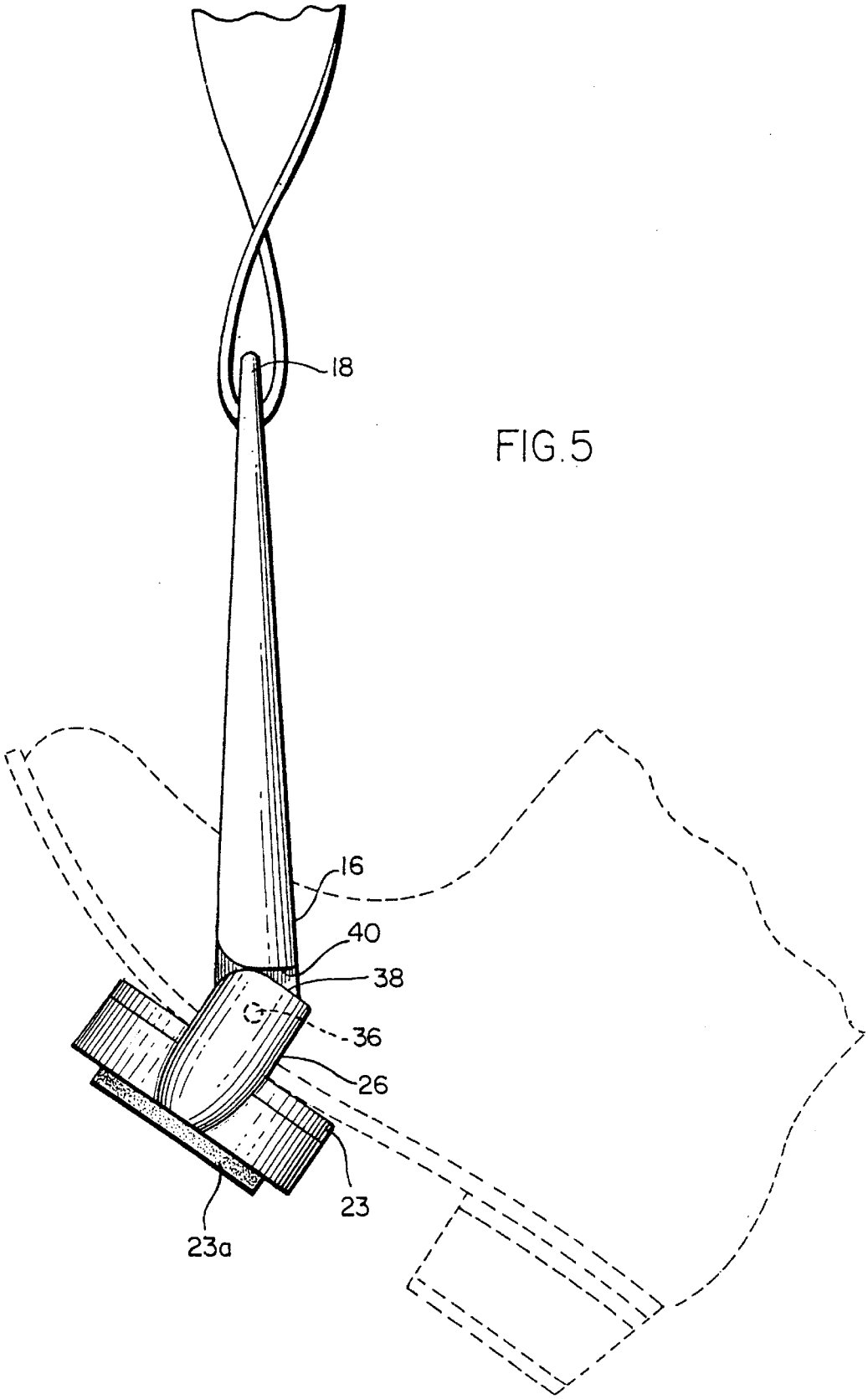
FIG. 5 is a right end view in elevation of the stirrup of FIG. 1 showing the pivotal connection as seen in FIG. 4 and showing in phantom a rider's boot tilting backwards in a "heels down, toes up" position.

Stop means are provided on the stirrup limbs and foot plate to define the limit of rotation of the foot plate with respect to the stirrup limbs. These stop means include shoulders 38 formed at the ends of the foot plate on the upper ends of the protrusions 24 and 26 and shoulders 40 formed on the lower ends of each of the limbs 14 and 16 on each side of the tongues 32 and 34. When the foot plate is rotated forwardly so that the shoulders 38 and 40 abut against each other as shown in FIG. 3 the foot plate 22 is in effect in a locked position, being restricted from further forward rotation. In that position it is at right angles with the limbs 14 and 16. The purpose of this restriction is to prevent the undesirable forward tendency or "toes down" characteristic. The foot plate is capable of substantially 90° backward rotation relative to the limbs of the stirrup but cannot rotate forwardly beyond the position where it makes right angles with the stirrup limbs. This ability to freely pivot 90° in a backward direction assists the rider in maintaining the "heels down, toes up" position in the stirrup. Furthermore this capability of freely pivoting 90° makes it possible for a rider to easily slip his foot out of the stirrup in the event of a fall. When the foot plate 22 is in a locked position horizontally as previously alluded to there is less danger of the rider's foot slipping through the stirrup than with a stirrup which allows the foot plate to pivot in both forward and backward directions.

In certain riding activities a rider oftentimes stands up in the stirrups. Even with the rider's full weight on the stirrup the rider still should be able to keep heels down and toes up. Some stirrups are constructed with a hinged connection located substantially halfway between the apex of the stirrup and the foot plate. Because of the location of that hinged connection it is virtually impossible for a rider in a standing position, for example, using such a stirrup, to pivot the foot plate and maintain the appropriate "heels down" position because of the excessive leverage required. Amongst other disadvantages this often results in a tremendous strain on the calves of the rider's legs. A stirrup embodying the invention herein does not present the aforementioned problem; quite to the contrary it takes the pressure off the ankles and calves, keeps the heels down and promotes a stable and correct leg position.

It will be apparent that I have advantageously provided an improved stirrup in which the foot plate locks in a horizontal position at right angles with the limbs resisting further forward rotation. At the same time the foot plate pivots freely 90° in the backward direction only, to facilitate the correct "heels down, toes up" position. This is unlike some other stirrups which rotate or swing in both directions allowing the undesirable forward tendency or "toes down" position of the foot. This potentially allows a rider to put a foot all the way through the stirrup and get it caught in the stirrup. The foot plate pivoting freely 90° in the backward direction also permits the foot to easily come free from the stirrup in the event of a fall. The right angle locking feature can also assist in mounting. By temporarily reversing the position of the stirrup the rider can use the right angle locking feature to provide a sure footing. Once mounted the stirrup can be reversed to its normal "heels down" position.

While a preferred embodiment of the invention has been disclosed, it will be appreciated that this is shown by way of example only, and the invention is not to be limited thereto as other variations will be apparent to those skilled in the art, and the invention is to be given its fullest interpretation within the terms of the following claims.

What is claimed is:

1. A stirrup comprising:

an inverted generally U-Shaped frame including two limbs extending substantially the full arc of said stirrup and terminating at opposed ends, and an attachment portion for a stirrup leather, a foot plate pivotally mounted at the ends of said two limbs, pivot means pivotally interconnecting the ends of said limbs and said foot plate, coacting stop means formed on the ends of said limbs and at the ends of said foot plate for limiting the forward rotation of said foot plate with respect to said limbs, said stop means being effective to restrict the forward rotation of said foot plate to a position where it is substantially at right angles with said limbs, said foot plate being freely rotatable in a backward direction through a range of approximately 90°.

2. The stirrup of claim 1 wherein said coacting stop means comprise first shoulder means formed on the ends of said limbs and second shoulder means formed at each end of said foot plate.

3. The stirrup of claim 2 wherein each end of said foot plate includes a protrusion integrally formed therewith, said second shoulder means being formed on an end of said protrusion.

4. The stirrup of claim 2 wherein said first and second shoulder means lie in vertical planes and are co-planar.

5. The stirrup of claim 1 wherein said coacting stop means comprises first shoulder means formed on the end of each of said limbs and second shoulder means formed at each end of said foot plate, said first and second shoulder means when in an abutting position being effective to restrict further forward rotation of said foot plate.

6. The stirrup of claim 1 wherein said pivot means includes means defining transverse grooves formed at each end of the foot plate, tongues formed on the ends of said limbs and extending into said grooves and pivot pins extending between said tongues and the walls defining said transverse grooves.

7. The stirrup of claim 1 wherein said foot plate is freely rotatable through a range of approximately 90° with respect to said limbs from an extreme forward position in which said foot plate is held in a restricted position by said stop means at substantially right angles with said limbs to an extreme backward position in which said foot plate is substantially parallel to said limbs.

8. The stirrup of claim 1 wherein said foot plate is constructed with an elongated aperture for receiving therethrough a resilient foot pad.

* * * * *